US007628609B2

(12) United States Patent
Pryor et al.

(10) Patent No.: US 7,628,609 B2
(45) Date of Patent: Dec. 8, 2009

(54) HUB AND SPOKE BURNER WITH FLAME STABILITY

(75) Inventors: William Michael Pryor, Portland, TN (US); Hector Jose Donastorg, Greenbrier, TN (US); John Thurl Pottenger, Hendersonville, TN (US); Michael Dennis Padgett, Cleveland, OH (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 11/768,642

(22) Filed: Jun. 26, 2007

(65) Prior Publication Data

US 2008/0160468 A1 Jul. 3, 2008

Related U.S. Application Data

(60) Provisional application No. 60/882,658, filed on Dec. 29, 2006.

(51) Int. Cl.
*F23D 14/58* (2006.01)

(52) U.S. Cl. ..... 431/286; 431/354; 126/39 E

(58) Field of Classification Search ..... 431/193, 431/286, 350, 354; 126/39 R, 39 E, 41 R
See application file for complete search history.

(56) References Cited

U.S. PATENT DOCUMENTS

| | | | | |
|---|---|---|---|---|
| 896,987 | A * | 8/1908 | Graves | 126/39 E |
| 1,125,726 | A | 1/1915 | Ruppel | |
| 1,196,230 | A | 8/1916 | Graves | |
| 1,214,819 | A | 2/1917 | Parks | |
| 1,285,733 | A | 11/1918 | Kennedy | |
| 1,720,909 | A | 7/1929 | Lang | |
| 1,781,386 | A | 11/1930 | Harner et al. | |
| 1,781,623 | A | 11/1930 | Zink | |

(Continued)

FOREIGN PATENT DOCUMENTS

| | | | |
|---|---|---|---|
| AU | 2841384 | A | 11/1985 |

(Continued)

OTHER PUBLICATIONS

International Search Report and Written Opinion of International Searching Authority mailed Mar. 28, 2008 in Application No. PCT/US2007/087052.

(Continued)

*Primary Examiner*—Carl D Price
(74) *Attorney, Agent, or Firm*—Banner & Witcoff, Ltd.

(57) ABSTRACT

A burner assembly for a gas powered cooking appliance is provided. The burner assembly may include a burner body including a central region and a plurality of radiating extensions extending radially outward from the central region. The burner assembly may include a burner cap with a central region and a plurality of radiating extensions extending radially outward from the central region. The burner cap is positioned on top of the burner body when the burner is assembled. The burner cap may include at least one overhang positioned on the outer perimeter of the central region and between an adjacent pair of radiating extensions. The at least one overhang forms a gap between the exterior wall of the burner body and the interior wall of the overhang. This gap, or flame stabilization chamber, provides for collection of gases and flame that aid in maintaining the flame during low temperature operation.

13 Claims, 5 Drawing Sheets

U.S. PATENT DOCUMENTS

| | | | | | |
|---|---|---|---|---|---|
| 1,806,800 | A | | 5/1931 | Herrenbruck | |
| 1,879,776 | A | | 9/1932 | Toelle | |
| 1,896,082 | A | | 2/1933 | Harper | |
| 1,921,778 | A | | 8/1933 | Roberts | |
| 1,971,449 | A | * | 8/1934 | Harper | 126/39 H |
| D094,610 | S | | 2/1935 | Hobson | |
| D094,689 | S | | 2/1935 | Hobson | |
| 2,023,624 | A | | 12/1935 | Tullis | |
| 2,074,966 | A | | 3/1937 | Kahn | |
| 2,081,507 | A | | 5/1937 | Reedy | |
| 2,138,925 | A | | 12/1938 | Kahn | |
| 2,148,777 | A | * | 2/1939 | Schneider et al. | 126/39 H |
| D125,112 | S | | 2/1941 | Reeves | |
| 2,232,482 | A | | 2/1941 | Schulz | |
| 2,257,399 | A | * | 9/1941 | Parker | 126/39 J |
| 2,320,754 | A | * | 6/1943 | Sherman | 126/39 K |
| 2,485,145 | A | | 10/1949 | Evans | |
| 3,044,459 | A | | 7/1962 | Brown | |
| 3,162,237 | A | * | 12/1964 | Brown et. al. | 126/39 R |
| 3,399,024 | A | | 8/1968 | Branson | |
| 3,592,180 | A | | 7/1971 | Kweller et al. | |
| 3,597,135 | A | | 8/1971 | Kweller et al. | |
| 3,627,462 | A | * | 12/1971 | Lotter | 431/284 |
| 3,825,404 | A | | 7/1974 | Lemonnier de Gouville | |
| 4,108,142 | A | | 8/1978 | Barson et al. | |
| 4,264,298 | A | | 4/1981 | Simeoni | |
| 4,565,523 | A | | 1/1986 | Berkelder | |
| 4,572,154 | A | | 2/1986 | Schweitzer | |
| 4,690,636 | A | | 9/1987 | Lemonnier de Gouville et al. | |
| 4,773,383 | A | | 9/1988 | Lemonnier de Gouville et al. | |
| 4,827,898 | A | | 5/1989 | Lioa et al. | |
| 4,891,006 | A | | 1/1990 | Lemonnier de Gouville et al. | |
| D315,081 | S | | 3/1991 | Archibald | |
| 5,079,909 | A | | 1/1992 | Bruckner et al. | |
| 5,133,334 | A | | 7/1992 | Riehl | |
| 5,133,658 | A | | 7/1992 | Le Monnier de Gouville et al. | |
| 5,285,627 | A | | 2/1994 | Losel et al. | |
| 5,328,357 | A | | 7/1994 | Riehl | |
| 5,345,756 | A | | 9/1994 | Jahnke et al. | |
| 5,391,076 | A | | 2/1995 | Home | |
| 5,397,234 | A | | 3/1995 | Kwiatek | |
| 5,405,263 | A | | 4/1995 | Gerdes et al. | |
| 5,464,345 | A | | 11/1995 | Kwiatek | |
| 5,468,145 | A | | 11/1995 | Ferlin | |
| 5,490,778 | A | | 2/1996 | Meijer | |
| D369,517 | S | | 5/1996 | Ferlin | |
| 5,628,302 | A | | 5/1997 | Schatz et al. | |
| 5,649,822 | A | | 7/1997 | Gertler | |
| 5,661,968 | A | | 9/1997 | Gabriel | |
| 5,724,807 | A | | 3/1998 | Schuetzenduebel et al. | |
| 5,765,542 | A | | 6/1998 | Fey et al. | |
| 5,865,100 | A | | 2/1999 | Knowles | |
| 5,887,418 | A | | 3/1999 | Bruckner et al. | |
| 5,899,681 | A | | 5/1999 | Maughan | |
| 5,924,860 | A | | 7/1999 | Massey et al. | |
| D414,377 | S | | 9/1999 | Huang | |
| 5,954,492 | A | | 9/1999 | Lannes et al. | |
| 6,030,207 | A | | 2/2000 | Saleri | |
| 6,082,994 | A | | 7/2000 | Grandveau et al. | |
| 6,146,132 | A | | 11/2000 | Harneit | |
| D439,801 | S | | 4/2001 | Measom | |
| 6,263,868 | B1 | * | 7/2001 | Koch et al. | 126/39 R |
| 6,299,436 | B1 | | 10/2001 | Huang | |
| 6,315,552 | B1 | * | 11/2001 | Haynes et al. | 431/285 |
| 6,318,993 | B1 | | 11/2001 | Huang | |
| 6,325,619 | B2 | * | 12/2001 | Dane | 431/284 |
| 6,371,754 | B1 | * | 4/2002 | Haynes | 431/286 |
| 6,439,882 | B2 | | 8/2002 | Haynes et al. | |
| 6,604,519 | B1 | * | 8/2003 | Bosser | 126/39 J |
| 6,655,954 | B2 | * | 12/2003 | Dane | 431/354 |
| 6,780,008 | B2 | * | 8/2004 | Koch et al. | 431/354 |
| 6,851,420 | B2 | | 2/2005 | Jennings | |
| D502,840 | S | | 3/2005 | Schulte et al. | |
| 6,938,423 | B2 | | 9/2005 | Strand | |
| D524,105 | S | | 7/2006 | Poltronieri | |
| 7,322,820 | B2 | * | 1/2008 | Welton et al. | 431/354 |
| 2003/0024525 | A1 | | 2/2003 | Jennings | |

FOREIGN PATENT DOCUMENTS

| | | | | |
|---|---|---|---|---|
| CH | 49497 | | | 11/1909 |
| DE | 2121103 | | | 4/1971 |
| DE | 9318510 | | | 7/1994 |
| EP | 491580 | A | | 6/1992 |
| EP | 0 534 302 | A | | 3/1993 |
| EP | 581655 | A | | 2/1994 |
| EP | 719982 | A1 | | 7/1996 |
| EP | 1099904 | A1 | | 7/2000 |
| EP | 1 099 904 | | * | 5/2001 |
| EP | 1 099 905 | | * | 5/2001 |
| EP | 1099905 | | * | 5/2001 |
| FR | 1 299 103 | A | | 7/1962 |
| FR | 2655711 | A1 | * | 6/1991 |
| FR | 2701542 | | | 8/1994 |
| GB | 158331 | | | 1/1921 |
| GB | 2153988 | A | | 8/1985 |
| GB | 2184535 | A | * | 6/1987 |
| GB | 2240168 | A | | 7/1991 |
| GB | 2302940 | A | | 2/1997 |
| JP | 54145030 | | | 11/1979 |
| JP | 55-33528 | | | 3/1980 |
| JP | 55102808 | | | 8/1980 |
| JP | 60011012 | A | * | 1/1985 |
| JP | 5952113 | | | 3/1985 |
| JP | 5864417 | | | 4/1985 |
| JP | 60245929 | | | 12/1985 |
| JP | 10165313 | A | | 6/1998 |
| JP | 11264516 | | | 9/1999 |
| JP | 200055371 | | | 2/2002 |
| WO | WO-9830838 | A1 | | 7/1998 |
| WO | WO-9920942 | A | | 4/1999 |
| WO | WO-0013562 | | | 3/2000 |
| WO | 01 75363 | A | | 10/2001 |
| WO | WO-2053879 | A1 | | 7/2002 |
| WO | 03 098107 | A | | 11/2003 |
| WO | WO03 091627 | A1 | * | 11/2003 |

OTHER PUBLICATIONS

International Search Report and Written Opinion of the International Searching Authority mailed Mar. 30, 2008 in Application No. PCT/US2007/087047.

Eight (8) photographs of Thermidor Burners taken Feb. 8, 2006.

International Preliminary Examination Report dated Mar. 20, 2003 in Application No. PCT/SE01/02891.

International Search Report dated May 5, 1999, in Application No. PCT/US98/21945.

International Search Report dated Mar. 12, 1999 in Application No. PCT/FR99/02139.

* cited by examiner

HUB AND SPOKE BURNER WITH FLAME STABILITY

CROSS REFERENCE TO RELATED APPLICATIONS

This application claims priority to U.S. Provisional Application No. 60/882,658, filed Dec. 29, 2006, entitled "Hub and Spoke Burner with Flame Stability and Port Configuration" and expressly incorporated herein by reference.

TECHNICAL FIELD

This application deals with a burner arrangement for a cooking appliance. More specifically, this application deals with a burner cap and burner port configuration that aids in providing flame stability for a gas burner on a stove or cooktop.

BACKGROUND

Conventional stoves, as used in home or commercial kitchens, are often gas powered. Cooking with gas provides an efficient cooking method while also providing good temperature control for the cook. In some conventional systems, a circular gas burner has been used to ensure consistent flow to all areas of the burner. However, circular gas burners provide heat only at a circular perimeter of the burner flame. This arrangement may lead to uneven heat distribution and/or uneven cooking. Alternate burner shapes have been developed, however, providing even gas flow to all areas of the burner is difficult.

In addition, gas burners are often sensitive to air pressure changes due to environmental conditions, such as a cupboard or oven door opening or closing. Changes in pressure may cause the burner flame to extinguish. Such pressure changes are particularly problematic at low temperature settings because the flow of gas to the burner has less velocity than at high temperature settings, making the flame less stable.

SUMMARY

In accordance with the present disclosure, a burner assembly for a gas powered cooking appliance is provided. The burner assembly may include a burner body which is coupled to a gas supply via a burner base. The burner body may include a central region and a plurality of radiating extensions extending radially outward from the central region. In addition, the burner assembly may include a burner cap with a central region and a plurality of radiating extensions extending radially outward from the central region. The burner cap is positioned on top of the burner body when the burner is assembled and protects the interior portion of the burner assembly.

In one arrangement, the burner cap may include a plurality of overhangs positioned on the outer perimeter of the central region and between each of the radiating extensions. The overhangs form a gap between the exterior wall of the burner body and the interior wall of the overhang. This gap, or flame stabilization chamber, provides for collection of gases that aid in re-igniting the burner should the flame be extinguished.

In addition, the burner body includes a plurality of sidewall openings disposed along the sidewall of the burner body. The burner body may include multiple regions wherein the characteristics of the sidewall openings within each region differ from the characteristics of sidewall openings in other regions.

The sidewall openings may include notches of multiple sizes or shapes. In addition, the sidewall openings may include fully bounded sidewall holes.

These and additional features and advantages of the invention disclosed here will be further understood from the following detailed description.

BRIEF DESCRIPTION OF THE DRAWINGS

The foregoing summary of the invention, as well as the following detailed description of illustrative embodiments, is better understood when read in conjunction with the accompanying drawings, which are included by way of example, and not by way of limitation with regard to the claimed invention.

DETAILED DESCRIPTION

The following discussion and accompanying figures disclose a burner assembly for use with a gas powered cooking appliance. The burner assembly arrangement described may be incorporated into any conventional gas powered stove or cooktop. For ease of understanding, the burner assembly will be described as being incorporated into a gas stove. In addition, the term gas generally refers to a cooking fuel that includes a mixture of natural gas and air. Additionally or alternatively, the cooking fuel used may be propane, butane, manufactured gas, and the like.

Figure 1:
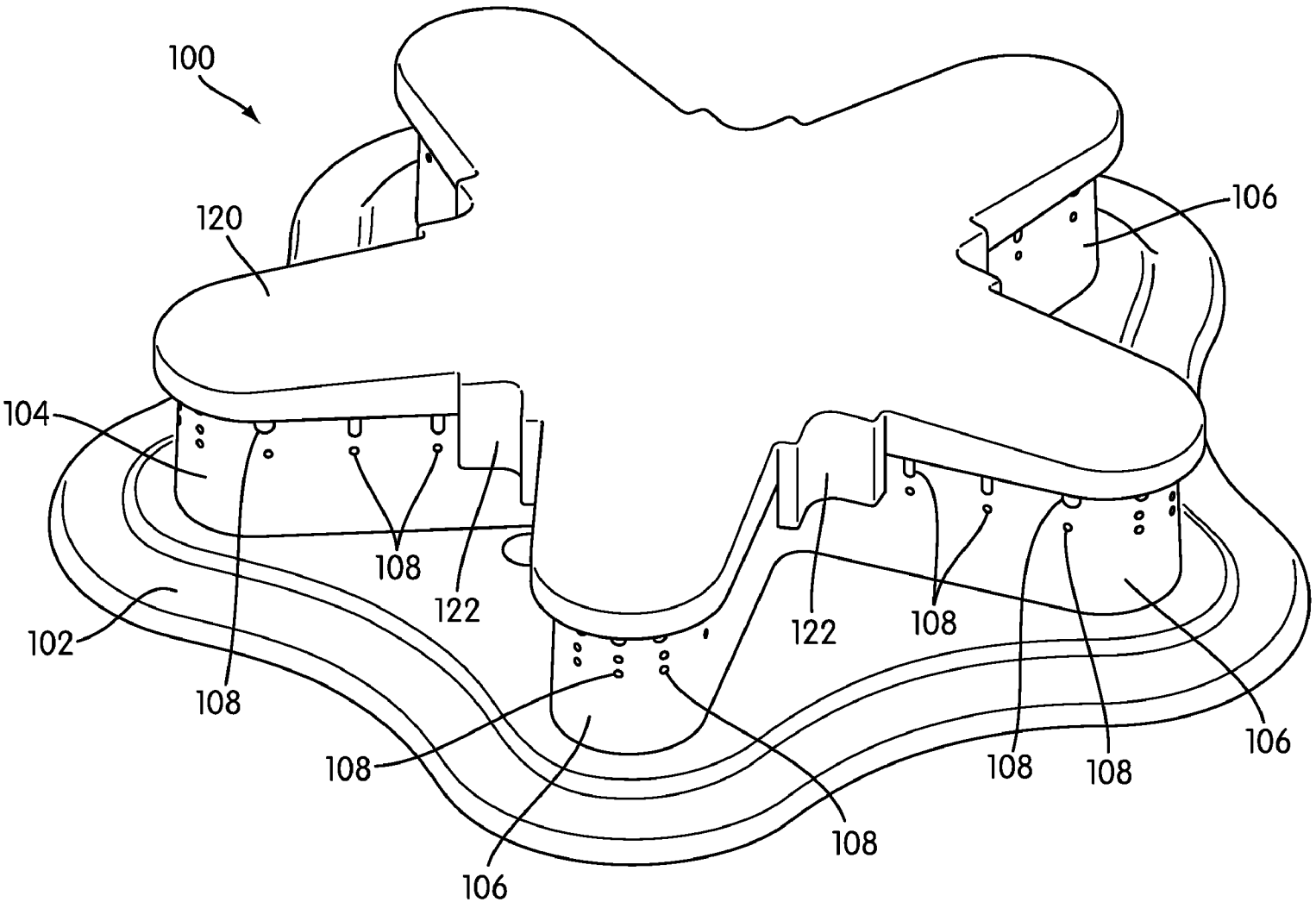
FIG. 1 is a perspective view of a burner assembly according to one arrangement.

A burner assembly 100 according to aspects of the disclosure is shown in FIG. 1. The burner assembly 100 generally includes a burner base (not shown) that is coupled to a gas supply and a valve. The burner base protrudes through the top of the stove and is connected to a burner body 104. In an alternate arrangement, a burner skirt 102 may be included on the top of the stove and the burner base may protrude therethrough. It is recognized that the burner can be used, generally, in one of two arrangements. In the first, a burner is provided on a metal cooking surface. In such an arrangement, the burner is mounted to the top of the cooktop. In the second arrangement, as depicted, the burner is mounted to a burner skirt. Such an arrangement is used with non-metal cooking surfaces such as glass top stoves. The burner skirt serves as an insulating barrier to heat in order to protect a glass cooktop.

The burner body 104 generally includes a central region (202 in FIG. 4) having an aperture (204 in FIG. 4) through which a gas/air mixture flows. The burner body 104 further includes a plurality of radiating extensions 106 that extend outward from the central region. The radiating extensions 106 create a sidewall of the burner body 104 and include a plurality of apertures 108 through which gas flows to sustain a cooking flame. In such an arrangement, the central region and radiating extensions form a hub and spoke configuration.

The burner assembly 100 further includes a burner cap 120. The burner cap 120 has a shape that generally corresponds to the burner body 104. In addition, in one particular arrangement, the burner cap 120 includes a plurality of overhangs 122 disposed at a central area 124 and between the radiating extensions 126. Although in many examples used herein the burner cap includes at least one overhang, the burner cap can be configured without any overhangs. For instance, the cap may have a generally planar bottom surface. The cap would then rest atop the burner body with no protrusions extending downward from the burner cap.

Generally gas stoves and cooktops include a plurality of burners arranged on a cooktop surface. As discussed above, the cooktops may be constructed of various materials including metals, such as stainless steel and porcelain coated enameling iron, or glass. Each of the burners is connected to a gas supply. The supply of gas to the burner is controlled by a valve. When a burner is turned on, the valve is controlled by user input, thereby controlling the amount of gas flowing to the burner. This user input may include rotation of a knob or selection of options on a touchpad to control the valve. Such a system is generally known in the art. At high temperature settings, gas flows to the burner at higher velocities and pressures, providing a hearty flame that may not be affected by environmental conditions and pressure changes. However, burners on low heat (i.e., allowing a minimum of gas to flow through the valve to the burner) have been known to flame out due to changes in pressure. In order to prevent such a flame out, the burner assembly shown in FIG. 1 includes flame stabilization chambers arranged about the burner assembly.

Figure 2:
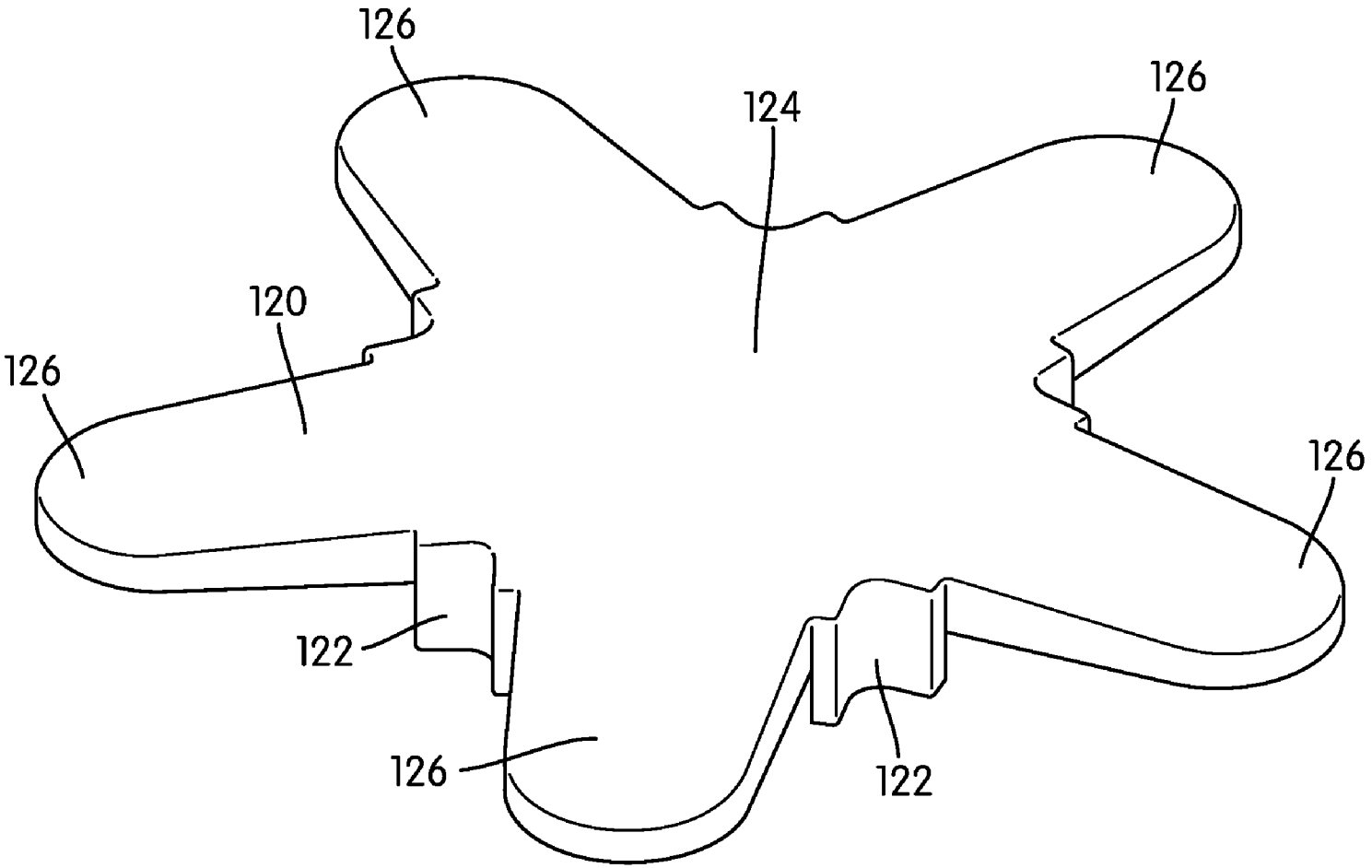
FIG. 2 is a perspective view of the burner cap of FIG. 1.

FIG. 2 provides an isolated view of the burner cap 120 shown in FIG. 1. The burner cap 120 includes a central region 124 or hub. The burner cap 120 may be substantially flat. Alternatively, the burner cap 120 may be slightly convex or substantially flat in the central region 124 and may slope downward as the surface extends away from the central region 124. When assembled, the central region 124 of the burner cap 120 mates with the central region of the burner body 104. The burner cap 120 may be removably fastened to the burner body 104. In an alternate arrangement, the burner cap 120 may rest atop the burner body 104 without being fastened to it.

In addition, the burner cap 120 includes a plurality of radiating extensions 126 extending radially outward from the central region 124. These radiating extensions 126 generally align with the radiating extensions 106 of the burner body 104 when the burner is assembled.

In addition, at least one downward overhang 122 is arranged on the burner cap 120. In the arrangement shown in FIG. 2, a plurality of downward overhangs 122 is arranged on the burner cap 120. The overhangs 122 are formed at an outer perimeter of the central region 124 and extend downward from the top surface. The overhangs 122 are substantially perpendicular to the top surface of the burner body 104. The overhangs 122 are disposed between each of the radiating extensions 126 and have an outer concave surface. The overhangs 122 also have an inner convex surface that is shaped complimentary to the corresponding region of the burner body 104. The overhangs 122 are spaced a small distance from the burner body 104 to form a gap between the burner body 104 and the overhang 122. In one burner arrangement, the distance from the burner body 104 to the overhang 122 may be between 0.10 inches and 0.30 inches. In one specific arrangement, the distance between the burner body 104 and the overhang 122 may be 0.18 inches to 0.19 inches. In an alternate arrangement, the distance between the burner body 104 and the overhang 122 may be between 0.17 and 0.18 inches.

Figure 3:
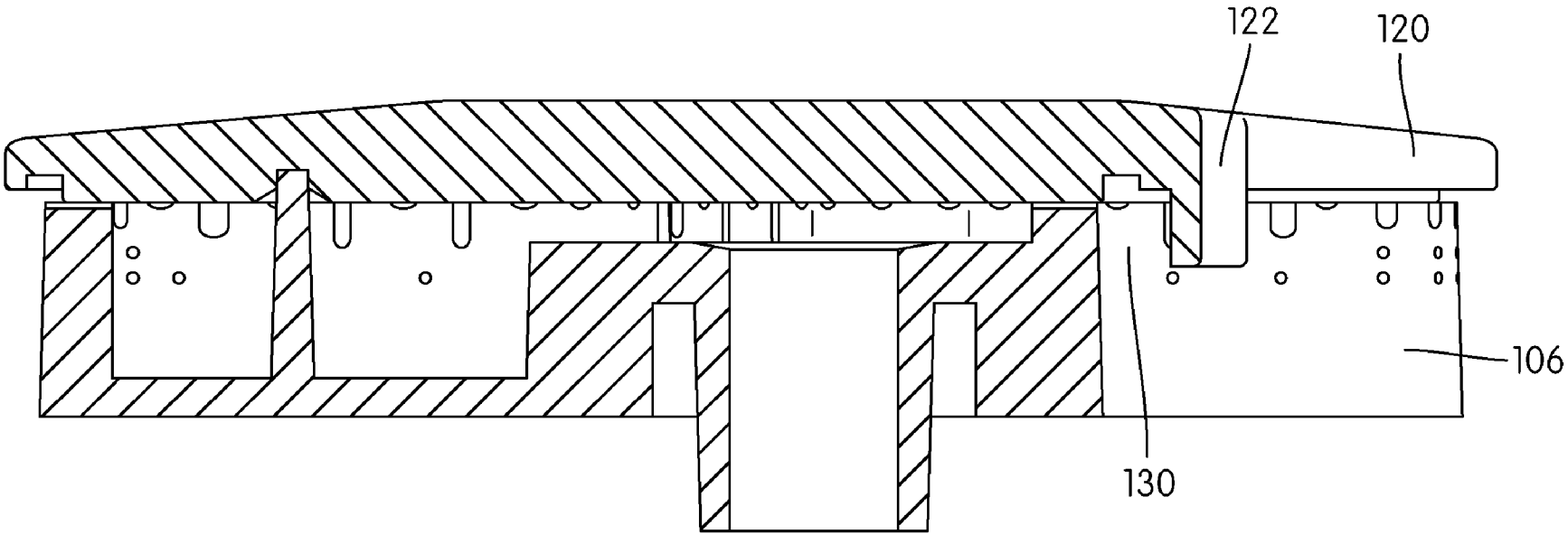
FIG. 3 is a cross-sectional view of the burner cap and burner body of the burner assembly of FIG. 1.

The overhangs 122 generally form an outer portion of a flame stabilization chamber (130 in FIG. 3). For instance, FIG. 3 shows a cross-section of a portion of the assembled burner 100. A portion of one of the radiating extensions 106 of the burner body 104 is shown. In addition, a corresponding portion of the burner cap 120 is also shown. The overhang 122 is shown as establishing a sort of barrier to protect the central region of the burner body 104. The outer perimeter of the central portion of the burner body 104 is shown as being set back from the overhang 122. This gap 130 formed by the exterior wall of the burner body 104 and the interior wall of the overhang 122 may maintain a presence of flame during burner operation and aid in preventing flame out when the burner is being operated at low temperatures. In one arrangement, the overhangs may be between 0.10 and 0.30 inches long and between 0.30 and 0.60 inches wide. For instance, in one exemplary arrangement, the overhangs may be between 0.19 and 0.20 inches long and between 0.40 and 0.50 inches wide. In yet another exemplary arrangement, the overhangs may be between 0.17 and 0.18 inches long and between 0.50 and 0.60 inches wide.

At low temperature operation, changes in pressure due to environmental factors or the opening of the oven door may cause the burner flame to extinguish in other designs. The flame stabilization chamber 130 formed by the gap between the overhang 122 and the exterior wall of the burner body 104 allows gas, including a presence of flame, to accumulate during burner operation and, should a pressure change occur, will aid in maintaining the flame until the flame is able to stabilize. In addition, the overhang 122 provides protection to the central portion (202 in FIG. 4) of the burner body 104 for all flow levels, and particularly for low flow. For instance, movement in a kitchen, such as a cupboard door near the cooking surface opening or closing, may cause the flame to extinguish or be temporarily interrupted in other designs. The overhangs 122 generally protect or shield the flow of gas or gas/air mixture in the central, interior portion of the burner assembly from such disruptions, thereby aiding in preventing flame out.

In addition, the overhangs 122 are positioned to aid in alignment of the burner cap 120 on the burner body 104 and prevent unintended rotation of the burner cap 120 on the burner body 104. Burner caps on conventional circular burners don't typically require an alignment feature. However, the hub and spoke arrangement of the burner arrangement described herein may benefit from an alignment mechanism, such as the overhangs, to ensure the cap is properly positioned on top of the burner body. To further aid in alignment, at least one of the radiating extension 106 of the burner body 104 may include at least one upward projection. This upward projection may be configured to mate with a corresponding recess in the burner cap 120. When assembling the burner, the upward projections may be used to properly align the burner cap 120 with the burner body 104 by aligning the upward projection with the corresponding recess in the burner cap 120.

Figure 4:
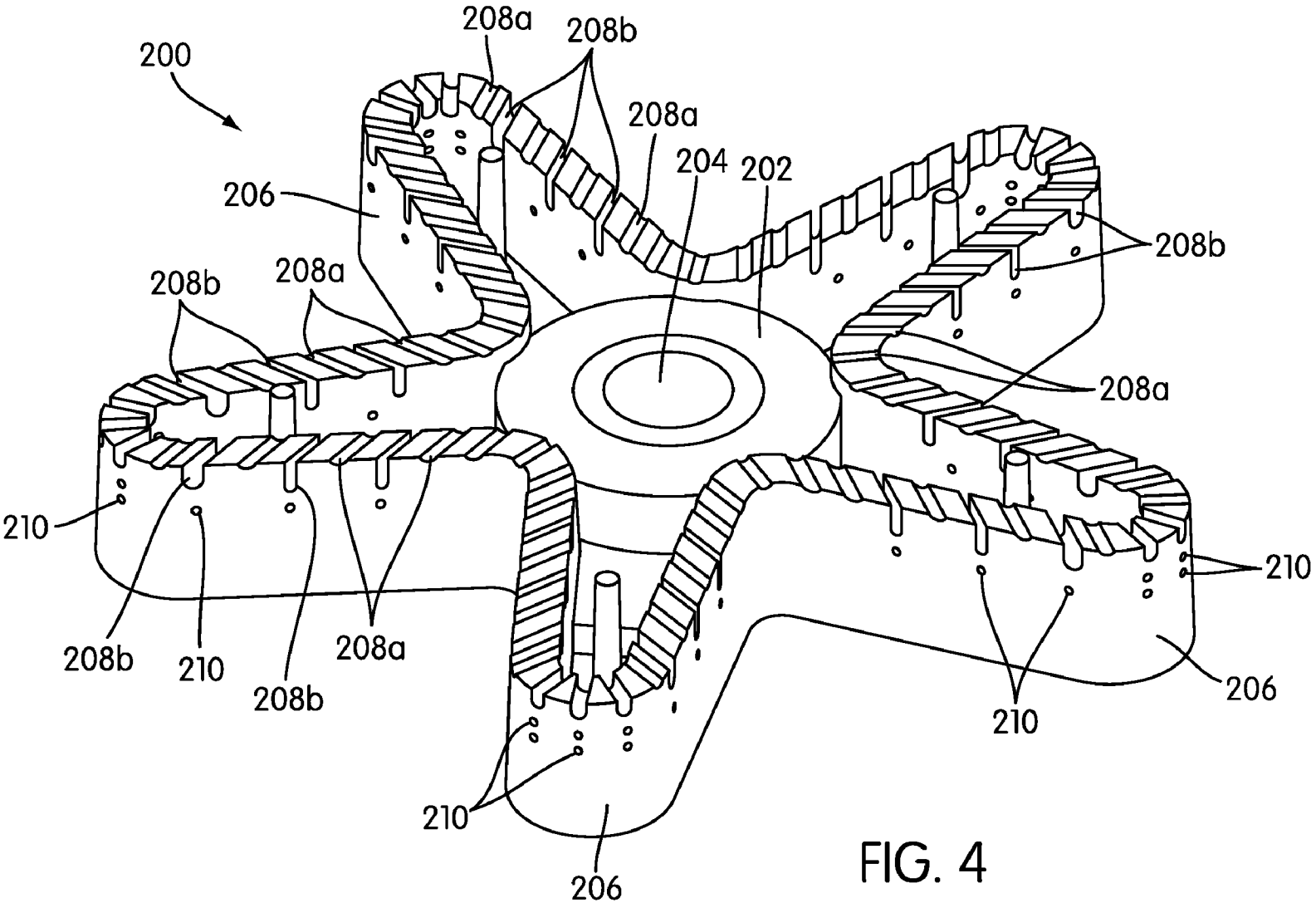
FIG. 4 is a perspective view of the burner body of FIG. 1.

FIG. 4 provides an overall view of the burner body of FIG. 1. As shown, the burner body 200 includes a central region 202 including an aperture or gas inlet 204 through which gas flows from the fuel source to the burner. In addition, the burner body 200 includes a plurality of radiating extensions 206 extending radially outward from the central region 202. The radiating extensions 206 are positioned equiangularly from each other, around the central region 202. In some cooking device arrangements, the burner body 200 may be arranged on a burner skirt (102 in FIG. 1) which is coupled to the cooking surface. The burner skirt may serve to prevent debris from entering the portion of the stove below the cooking surface. In addition, the burner skirt serves as an insulating barrier to heat on a glass cooktop model. Still further, the skirt may provide a mounting surface for mounting the burner body above a glass cooktop.

Figure 5:
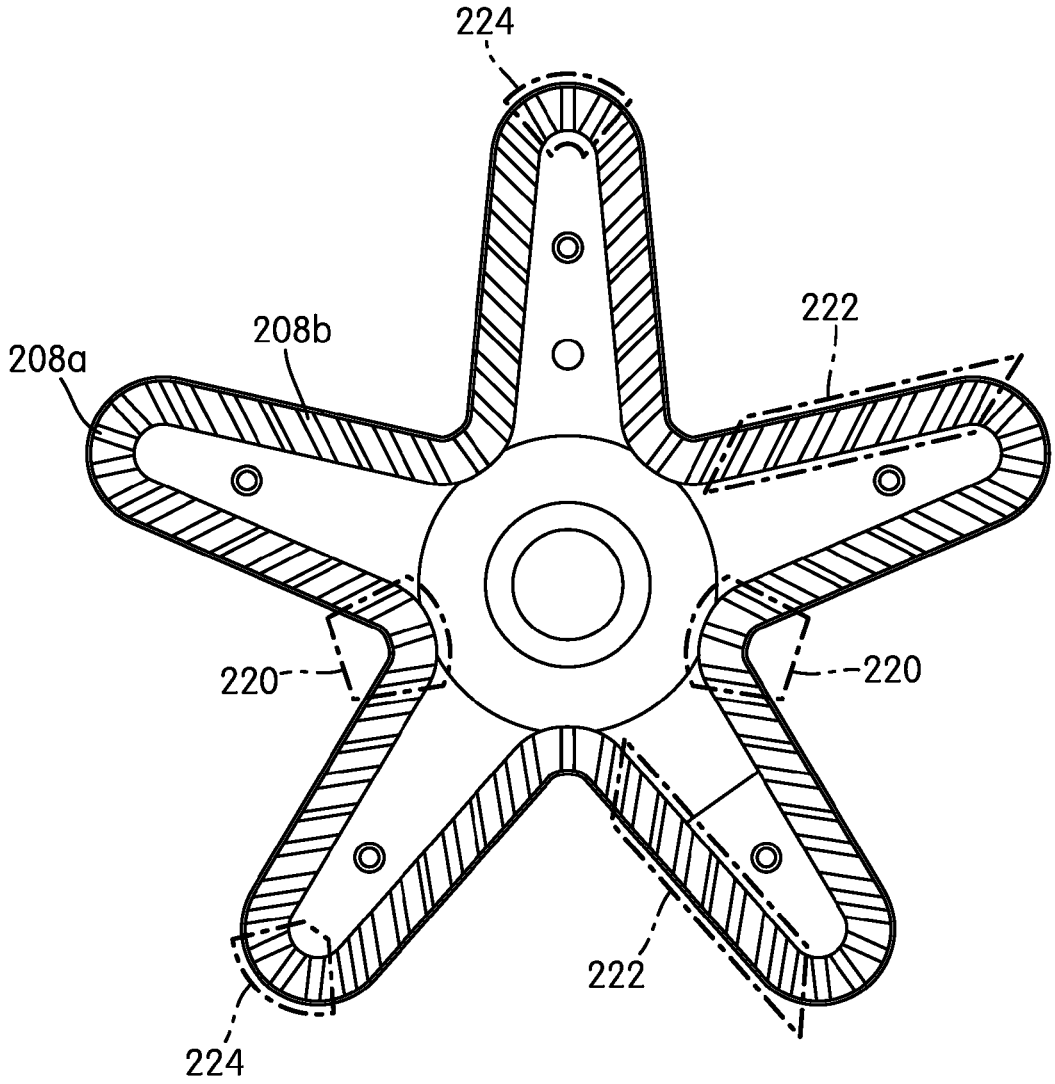
FIG. 5 is a top view of the burner body of FIG. 1.
Figure 6:
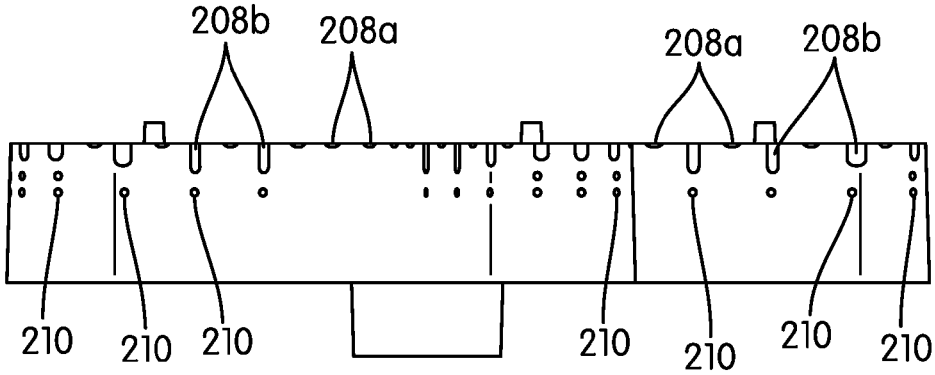
FIG. 6 is a side view of the burner body of FIG. 1.

As shown in FIGS. 4-6, each radiating extension 206 of the burner body 200 includes a plurality of apertures or sidewall openings 208*a*, 208*b*, 210 through which a a gas/air mixture may pass or through which the gas/air mixture may flow to maintain the cooking flame. The sidewall openings 208*a*, 208*b*, 210 may be of varying sizes and shapes. In one arrangement, the sidewall openings may include a plurality of round ports through which cooking flames may pass. The round ports are generally fully bounded sidewall holes, i.e., holes pass through the entire sidewall and are fully surrounded by the sidewall. In one arrangement, the fully bounded sidewall holes may have a radius between 0.7 and 1.1 mm. For instance, in one exemplary arrangement, the fully bounded sidewall holes may have a radius of 0.9 mm. In the arrangement shown in the figures, the fully bounded sidewall holes are generally a substantially similar size. However, other arrangements may be used wherein the fully bounded sidewall holes included holes of varying sizes within the size range provided. Alternatively or additionally, the radiating extensions 206 may include a plurality of notches 208*a*, 208*b* through which a cooking flame may pass. The notches may be formed in a top portion of the sidewall and may include an open end that forms a portion of the top surface of the burner body. In yet another arrangement, a combination of notches 208*a*, 208*b* and fully bounded sidewall holes 210 may be used to maintain the cooking flame. In one arrangement, the notches may range from 0.10 to 3.50 mm in height and 0.03 and 0.12 in width at the open end. In addition, the radius of the closed end of each notch may be between 0.30 and 1.00 mm.

The hub and spoke type arrangement of the burner body 200 and burner assembly in general, aids in providing improved heat distribution to provide more even cooking. For instance, conventional circular burners on a gas stove or cooktop only provide heat at the outer perimeter of the burner. This may prevent an even heat distribution across the bottom surface of a cooking implement, such as a pot, and may diminish cooking efficiency. The hub and spoke arrangement described provides improved distribution of heat from an inner central region of the burner along the radiating extensions to an outer region, thereby distributing heat along a wider portion of the cooking implement.

FIGS. 5 and 6 show top and side views of the burner body 200, respectively. The burner body 200 may include an arrangement of apertures or sidewall openings that varies depending on the location of the aperture on the burner body 200. For instance, the burner body 200 may include multiple regions in which the characteristics of the sidewall openings of each region are different from the characteristics of the sidewall openings in the other regions. The arrangement shown in FIG. 5 identifies three different regions 220, 222, 224 on the burner body 200. For example, region A 220 may generally be identified as the region most proximal to the central region 202 of the burner body 200. In one exemplary arrangement, region A 220 may be between 0.6 and 0.9 inches in length. In addition, region A 220 may comprise 15-25% of the burner body between a point most proximal the central region and a point most distal the central region on each radiating extension.

Region C 224, as shown, may be generally located most distal to the central region 202 and at an outermost end of the radiating extensions 206. In one illustrative example, region C 224 may be between 1.75 and 1.95 inches in length and may comprise 25-40% of the burner body between a point most proximal the central region and a point most distal the central region on each radiating extension. Region B 222, as shown, may be generally located along each of the radiating extensions 206 between region A 220 and region C 224. In one illustrative arrangement, region B may be 2.0 to 3.0 inches in length and may comprise 40-70% of the burner body between a point most proximal the central region and a point most distal the central region on each radiating extension.

In one arrangement, the characteristics of the sidewall openings within any one region may differ from the characteristics of the sidewall openings in the other two regions. Identification of these three regions is for illustrative purposes and is merely exemplary. Greater variation in the pattern, size and type of sidewall opening may be used. Additionally, the characteristics of the sidewall openings, such as distribution, size, shape, and the like, may differ over greater or fewer than three regions.

The three regions 220, 222, 224 identified provide varying degrees of gas/air mixture flow to sustain the cooking flame. In one arrangement, each of the regions includes notches 208*a*, 208*b* and/or fully bounded sidewall holes 210 that differ in size and/or configuration from the other regions. For example, region A 220 may include shallow notches 208*a* to allow gas to flow through. In the arrangement shown in FIG. 5, region A is located behind the burner cap overhangs (122 in FIG. 2) to form the flame stabilization chamber. The shallow notches 208*a* in region A allow gas to flow into the flame stabilization chamber (130 in FIG. 3) and accumulate therein, as discussed above. Region B 222 may also include a plurality of shallow notches 208*a*. In addition, region B 222 may include a plurality of larger or deeper notches 208*b*. The shallow and deeper notches 208*a*, 208*b* may be arranged in various patterns. In one arrangement, the shallow and deeper notches 208*a*, 208*b* are arranged in an alternating pattern. In one exemplary arrangement, the deeper notches may be 5 to 9 times larger than the shallow notches. In yet another exemplary arrangement, the deeper notches may be 3 to 10 times larger than the shallow notches.

The notches 208*a*, 208*b* are disposed in the sidewall of the burner body 200 and include an upper open end that forms a portion of the top surface of the burner body 200. When the burner cap (120 in FIG. 1) is positioned on top of the burner body 200, the notches 208*a*, 208*b* provide a passageway from the interior portion of the burner assembly to an outer region in order to maintain the cooking flame.

The shallow notches 208*a* are disposed in the sidewall of the burner body 200 and include an upper open end that forms a portion of the top surface of the burner body 200. The shallow notches 208*a* are generally provided to allow gas or gas/air mixture to flow through the burner body 200 to maintain a cooking flame. In addition, the shallow notches aid in allowing cross-over of the flame during lighting and operation. For instance, the shallow notches located between the deeper notches may aid in providing flame in the space between the deeper notches in order to provide more even lighting of the burner. The deeper notches 208*b* are generally provided to allow gas to flow through and may also be provided to support a cooking flame. For instance, the cooking flame may protrude from each of the deeper notches 208*b*. In such an arrangement, the cooking flame would be distributed along the length of each of the radiating extensions at each major notch 208*b* to provide relatively even heating of the cooking implement. This arrangement including a combination of shallow and deeper notches provides more even lighting and heat for the burner. In addition, the arrangement uses secondary air more efficiently by providing additional openings in which air can enter and mix with the natural gas to provide a combustible gas/air mixture.

Region B 222 may also include a plurality of fully bounded sidewall holes 210. The fully bounded sidewall holes 210 may be any suitable shape to allow gas to flow through the holes 210 to aid in maintaining the cooking flame. For instance, the fully bounded sidewall holes 210 may be circular, square, rectangular, and the like. In the arrangement shown in FIGS. 4-6, the fully bounded sidewall holes 210 are circular and are positioned below the deeper notches 208*b*. In addition, the fully bounded sidewall holes 210 are aligned with the deep notches 208*b* and are disposed in the sidewall of the burner body 200. The fully bounded sidewall holes 210 provide an additional path for gas to escape the interior portion of the burner assembly. The position of the fully bounded sidewall holes 210 below the deep notches 208*b* provides a function similar to that of the shallow notches. For instance, the fully bounded sidewall holes may aid in flame cross-over for more even lighting of the burner and more even heat distribution. In addition, the fully bounded sidewall holes provide an additional opening through which secondary air may flow into the central portion of the burner to mix with the natural gas. Still further, the fully bounded sidewall holes aid in preventing flame lift, which may occur when the velocity of the gas exceeds the velocity of the flame, thereby lifting the flame from the burner. In the arrangement shown in FIGS. 4-6, a single fully bounded sidewall hole 210 is provided below each deep notch 208*b*. Although additional fully bounded sidewall holes 210 may be provided in region B 222, a single fully bounded sidewall hole 210 may be sufficient to provide the functional advantages described.

Region C 224 may also include notches. In one arrangement, region C 224 includes deep notches 208*b*. In addition, region C may include a plurality of fully bounded sidewall holes 210. In one arrangement, the fully bounded sidewall holes 210 may be aligned with the deep notches 208*b* of region C 224 and may be positioned below the deep notches 208*b*. Similar to the arrangement in FIG. 2, the position of the fully bounded sidewall holes 210 below the deep notches 208*b* aid in flame cross-over during lighting and aid in providing more even heat distribution.

The arrangement of FIGS. 4-6 includes two fully bounded sidewall holes 210 positioned below each deep notch 208*b* in region C. The use of two fully bounded sidewall holes 210 is merely exemplary. Any number of fully bounded sidewall holes 210 may be used, as long as there is space to accommodate the holes. In one arrangement, two fully bounded sidewall holes are used to provide a more even flame at the most distal point of the burner.

Varying the arrangement of sidewall openings in the burner body 200 provides improved flow to various portions of the burner. For instance, adding additional fully bounded sidewall holes 210 at the portion of the burner most distal to the central region allows additional gas to flow to the outer points of the burner. In areas where the gas has a shorter distance to flow, for instance, region B, fewer fully bounded sidewall holes may be used. The arrangement and number of sidewall openings used in various regions may provide additional flow in some regions and less flow in regions where appropriate.

In addition, the burner body arrangement having the sidewall openings arrangement described may be used with any type of burner cap. For instance, the burner cap may be shaped to correspond to the burner body. The burner cap may have a substantially planar bottom surface without downward protrusions. In yet another arrangement, the burner cap may have at least one downward protrusion or overhang.

In light of the foregoing disclosure and description of various arrangements, those skilled in this area of technology will readily understand that various modifications and adaptations can be made without departing from the scope and spirit of the invention. All such modifications and adaptations are intended to be covered by the following claims.

What is claimed is:

1. A burner assembly for a gas powered cooking appliance, comprising:

a burner body having a supply aperture through which gas is supplied to the burner, a central region, and a plurality of radiating extensions extending radially outward from the central region and forming a sidewall surrounding the aperture, the radiating extensions including a plurality of sidewall openings through which gas flows; and a burner cap shaped to generally correspond to the burner body arrangement and including at least one overhang having an outer concave surface and positioned at a junction between an adjacent pair of radiating extensions and forming a flame stabilization chamber formed in part by a portion of an exterior wall of the burner body, wherein the at least one overhang overhangs a portion of the sidewall in a central region between the adjacent pair of radiating extensions but does not overhang the sidewall along a straight side of the radiating extensions.

2. The burner assembly of claim 1, wherein the at least one overhang further includes an inner facing convex surface shaped to correspond to a shape of the burner body.

3. The burner assembly of claim 2, wherein the inner facing convex surface is spaced a distance between 0.10 and 0.30 inches from the sidewall of the burner body.

4. The burner assembly of claim 1, wherein the at least one overhang extends downward from a top surface of the burner cap and is arranged substantially perpendicular to a top surface of the sidewall.

5. The burner assembly of claim 4, wherein the at least one overhang covers at least half of a height of the sidewall of the burner body at a point proximal to the central region.

6. The burner assembly of claim 1, wherein the at least one overhang is positioned to align the burner cap with the burner body on assembly.

7. The burner assembly of claim 1, wherein the flame stabilization chamber retains gas and a presence of flame during burner operation.

8. The burner assembly of claim 1, further including a plurality of overhangs arranged at a junction between each adjacent pair of radiating extensions.

9. The burner assembly of claim 8, wherein each of the overhangs of the plurality of overhangs includes a convex inner surface.

10. The burner assembly of claim 1, wherein the burner body includes at least five radiating extensions.

11. The burner assembly of claim 1, wherein the burner cap rests on top of the burner body.

12. The burner assembly of claim 1, wherein the at least one overhang prevents unintended rotation of the burner cap relative to the burner body in an in-use state.

13. The burner assembly of claim 1, wherein the at least one overhang includes a bottom edge, the bottom edge extending below the at least one sidewall opening to cover at least a portion of the sidewall opening.

* * * * *

UNITED STATES PATENT AND TRADEMARK OFFICE

CERTIFICATE OF CORRECTION

PATENT NO. : 7,628,609 B2
APPLICATION NO. : 11/768642
DATED : December 8, 2009
INVENTOR(S) : William Michael Pryor et al.

It is certified that error appears in the above-identified patent and that said Letters Patent is hereby corrected as shown below:

In Other Publications, Continued on Page 2, Line 61:
Please delete "May 5, 1999" and insert --May 2, 1999--.

Signed and Sealed this

Twentieth Day of July, 2010

David J. Kappos

David J. Kappos
*Director of the United States Patent and Trademark Office*